United States Patent [19]

Bon et al.

[11] Patent Number: 4,755,266

[45] Date of Patent: Jul. 5, 1988

[54] PROCESS FOR SILVER CATHODE ACTIVATION

[75] Inventors: Charles K. Bon, Concord; Vera M. Knowles, Martinez, both of Calif.

[73] Assignee: The Dow Chemical Company, Midland, Mich.

[21] Appl. No.: 884,447

[22] Filed: Jul. 11, 1986

[51] Int. Cl.[4] ..... C25F 1/00

[52] U.S. Cl. ..... 204/141.5; 204/73 R; 204/292; 134/2; 423/604

[58] Field of Search ..... 134/2; 204/73 R, 140, 204/141.5, 292; 423/604

[56] References Cited

U.S. PATENT DOCUMENTS

| | | | |
|---|---|---|---|
| 3,253,961 | 5/1966 | Jung et al. | 429/40 |
| 4,003,757 | 1/1977 | Lux et al. | 423/604 |
| 4,217,185 | 8/1980 | Kyriacou et al. | 204/73 R |
| 4,242,183 | 12/1980 | Kyriacou et al. | 204/73 R |
| 4,460,441 | 7/1984 | Domning | 204/74 |

OTHER PUBLICATIONS

Hackh's Chemical Dictionary, 1969, McGraw-Hill Inc. p. 481, "Oxidizing".

*Primary Examiner*—John F. Niebling
*Assistant Examiner*—Kathryn Rubino
*Attorney, Agent, or Firm*—D. Wendell Osborne

[57] ABSTRACT

Silver cathodes used in electrochemical synthesis are activated or reactivated after a period of use by immersion in a dilute alkaline aqueous solution of a compatible oxidizing agent. Thus, an expanded silver sheet cathode in an electrolytic cell used for the conversion of 3,4,5,6-tetrachloropicolinic acid to the herbicide 3,6-dichloropicolinic acid was reactivated by circulating an aqueous solution containing about 0.5 percent sodium hypochlorite and about 2 percent sodium hydroxide through the cell.

12 Claims, No Drawings

PROCESS FOR SILVER CATHODE ACTIVATION

BACKGROUND OF THE INVENTION

Silver cathodes utilized in electrochemical synthesis, such as those disclosed in U.S. Pat. Nos. 4,242,183, 4,217,185, 4,460,441, and the references therein, are known to require activation to perform at high efficiency. They are further known to decrease in efficiency with use and to require periodic reactivation for continuing operations.

Activation and reactivation of silver cathodes is generally achieved by an anodization process in which the unactivated electrode is dipped or immersed in a catholyte containing water and hydroxide ions and anodically polarized, thereby converting some of the silver in the cathode surface to colloidal silver oxide, roughening and corroding the surface at the same time. The polarity of the electrode is then reversed and the oxide is electrolytically converted to microcrystalline silver which is active in electrochemical synthesis. The polarity reversal is generally repeated several times at intervals. Another convenient method of activating or reactivating silver cathodes is to add a small amount of water soluble silver salt, such as silver nitrite, to a catholyte containing water and hydroxide ions, under sufficient agitation to keep the resultant colloidal, hydrous silver oxide particles well dispersed. The silver oxide particles thus formed are reduced to electrolytically effective microcrystalline silver when a current is applied. These methods are discussed in U.S. Pat. No. 4,242,183.

The current activation and reactivation procedures are useful, but do not activate or reactivate the cathodes to their maximum possible efficiency. Since the economics of electrochemical processes are in large measure determined by the efficiency of the electrolytic cell employed, improved and simplified methods of activation and reactivation are desirable.

SUMMARY OF THE INVENTION

The present invention relates to the activation and reactivation of silver cathodes by oxidizing agents.

It has now been found that silver cathodes are activated and reactivated by contacting the cathodes with solutions of compatible oxidizing agents.

Thus, a silver cathode used in electrochemical synthesis is activated or reactivated by a method which comprises contacting the cathode with an alkaline aqueous solution comprising an essentially heavy metal free oxidizing agent capable of oxidizing silver to silver oxide for a period of time sufficient to increase the efficiency of the cathode.

The method can be used independently or in conjunction with other activation and reactivation methods.

DETAILED DESCRIPTION OF THE INVENTION

The activation and reactivation process for silver cathodes of the present invention is readily carried out by contacting the cathodes with a solution containing an oxidizing agent in an electrolytic cell or in any other suitable container. The method of obtaining the contact is not critical and can be carried out in any conceivable manner. For example, the cathode can be immersed in the solution manually or mechanically by moving either the cathode or the vessel containing the oxidizing agent. Alternatively, the oxidizing solution can be added to a vessel containing the cathode, which vessel can be the electrolytic cell in which the cathode is installed. Preferably, the oxidizing solution is circulated through an electrolytic cell containing the silver cathode to be activated or reactivated. This procedure requires a minimum of both equipment and time.

In a typical reactivation procedure, an electrolytic cell is removed from service and the electrolyte drained from the cell. The cell is rinsed with water and is, optionally, cleaned by contacting it with a strong mineral acid, such as concentrated aqueous hydrochloric acid, as is taught in the art. An alkaline aqueous solution containing a compatible oxidizing agent is next circulated through the cell to activate the cathode. The oxidizing solution is then drained from the cell and, optionally, the cell is rinsed with water or electrolyte. Finally, the cell is refilled with electrolyte at which time it is ready to be placed into service again. It is, however, sometimes desirable to anodize or otherwise electrolytically activate the silver cathode before use in addition to the process of this invention. A typical original activation procedure for a silver cathode is similar except that the cell need not be removed from service and the electrolyte drained.

In an analogous manner, a silver cathode before installation into an electrolytic cell or after removal from a cell following a period of use can be activated or reactivated using one or more containers other than that electrolytic cell.

Compatible oxidizing agents suitable for use in the process of the present invention are those that can exist in alkaline aqueous solutions, are capable of oxidizing metallic silver to silver oxide, and do not contain significant quantities of heavy metal ions. Such compatible oxidizing agents include alkali and alkaline earth metal hypohalites, halites, halates, perhalates, nitrites, peroxides, hydroperoxides, $C_1$–$C_4$ peralkanoates, and perbenzoates. These agents, of course, can be added directly or can be prepared in situ from an alkali or alkaline earth metal hydroxides or oxides and the appropriate halogen, acid, or hydrogen peroxide. In the foregoing halogen refers to chlorine and bromine. Heavy metal ions are avoided because they are deleterious to silver cathodes. Some specific examples of suitable oxidizing agents include sodium hypochlorite, potassium hypobromite, magnesium chlorate, sodium bromate, calcium chlorite, potassium bromite, potassium peroxide, sodium nitrite, sodium hydroperoxide, potassium peracetate, and sodium perbenzoate. Sodium hypochlorite is generally available, inexpensive, and convenient to employ and is preferred.

The aqueous solutions of suitable oxidizing agents employed in the present invention contain a concentration of the oxidizing agent sufficiently high to oxidize a portion of the silver cathode to silver oxide and as a result activate or reactivate the electrode. Generally dilute solutions are employed. Concentrations of about 0.001 percent to about 10 percent by weight of the oxidizing agent are typical. Concentrations of about 0.01 percent to about 1 percent are preferred and those of about 0.05 to about 0.5 percent are especially preferred.

The aqueous solutions of the present invention may contain substances in addition to the oxidizing agent. An alkali metal or alkaline earth metal hydroxide, such as sodium hydroxide, or potassium hydroxide, is normally present, as it is important that the oxidizing solution be alkaline; that is, have a pH greater than 7. It is preferred that the pH be greater than 8 and especially preferred that it be greater than 9. Other compatible dissolved or suspended substances, including the starting materials, products, and by-products of electrochemical processes and organic solvents may be present if desired. Compatible substances are those that do not react with silver, do not contain heavy metals or their ions, and are not oxidized by the oxidizing agent.

The contact between the silver cathode and the oxidizing solution is continued until the cathode has gained or regained most or all of its potential efficiency. Contact times in excess of those required should be avoided so as to minimize the loss of silver by oxidation. Generally, contact times of about 0.03 to about 3 hours are appropriate. Contact times of about 0.1 to about 1 hour are preferred and of about 0.25 to about 0.75 are especially preferred. The temperature and pressure at which contact is made are not critical and it is generally most convenient to carry out the process at ambient temperatures and atmospheric pressure.

The oxidizing solution is generally drained from a reactivated electrolytic cell before the electrolyte is reintroduced and the current reapplied. In many cases, however, including the case of sodium hypochlorite, it is possible to reintroduce the electrolyte and reapply the current without draining the cell as the oxidizing agent decomposes into substances that are non-deleterious to the system when current is applied.

Silver cathodes are generally useful in electrochemical synthesis and are specifically useful in the preparation of the herbicide 3,6-dichloropicolinic acid by electrochemical reduction of 3,5,6-trichloro- and 3,4,5,6-tetrachloropicolinic acid. The process of this invention is especially useful in conjunction with that preparation.

The following examples are presented to illustrate the invention and should not be construed as limiting.

EXAMPLE 1

An expanded silver sheet cathode used in the electrochemical conversion of 3,4,5,6-tetrachloropicolinic acid that had lost activity as a result of its use was found to have a current density of 0.17 amps/in$^2$ which is 33 percent of normal. The cathode was soaked in an aqueous 0.5 percent by weight sodium hypochlorite solution for 30 minutes. It was rinsed with water and thereafter was found to have a current density of 0.80 amps/in$^2$. The initial and final current densities were measued at the same voltage.

EXAMPLE 2

An expanded silver cathode in use continuously for the reduction of 3,4,5,6-tetrachloropicolinic acid to 3,6-dichloropicolinic acid, is reactivated without removal from its electrolytic cell. The cell is shut down, drained and then rinsed sequentially with water, 18 percent hydrochloric acid, and water. An aqueous solution containing 2 percent sodium hydroxide and a 0.5 percent sodium hypochlorite is then pumped into the cell and is circulated in the cell for about 20 min. This solution is then drained from the cell and the cell returned to service. Cells reactivated in this way twice a day produced an average of 41.5 lb of 3,6-dichloropicolinic acid per operating hour whereas cells activated similarly except for the use of sodium hypochlorite produced an average of only 34.5 lb per operating hour.

EXAMPLE 3

An electrolytic flow cell with a stainless steel anode and a silver mesh cathode filled with an electrolyte which was a aqueous solution containing about 2 percent sodium hydroxide and about 1 percent tetrachloropicolinic acid had a cathode current density of only about 0.021 amps/cm$^2$ at about 1.2 volts due to inactivation. Standard methods of activating the cathode including anodization or rinsing with 16 percent hydrochloric acid or 20 percent sulfuric acid had a negligible effect. An aqueous 0.5 percent sodium hypochlorite solution, which had a pH of about 10, was circulated through the cell for about 30 min. The cell was refilled with the original electrolyte and found to have a cathode current density of about 0.128 amps/cm$^2$ at about 1.2 volts. The potentials were measured with a silver-silver chloride reference electrode connected through a capillary just behind the silver electrode.

EXAMPLE 4

Example 3 was repeated except that the activating solution contained 0.075 percent sodium hypochlorite with a pH of about 9.4 and this was circulated through the cell for about 35 min. The activated cathode had a current density of about 0.128 amps/cm$^2$ at about 1.2 volts.

What is claimed is:

1. A method of activating or reactivating a silver cathode used in electrochemical synthesis which comprises contacting the cathode with an alkaline aqueous solution containing as the only activating or reactivating substances one or more essentially heavy metal free oxidizing agents capable of oxidizing silver to silver oxide for a period of time sufficient to increase the efficiency of the cathode.

2. A method according to claim 1 wherein the oxidizing agent is an alkali or alkaline earth metal hypochlorite, chlorite, chlorate, perchlorate, hypobromite, bromite, bromate, perbromate, nitrite, peroxide, hydroperoxide, $C_1$–$C_4$ peralkanoate, or perbenzoate.

3. A method according to claim 2 wherein the oxidizing agent is sodium hypochlorite.

4. A method according to claim 2 wherein the oxidizing agent is sodium hydroperoxide.

5. A method according to claim 1 wherein the cathode is additionally activated or reactivated by electrochemical anodization.

6. A method according to claim 1 wherein the alkaline aqueous solution has a pH greater than 8.

7. A method according to claim 6 wherein the alkaline aqueous solution has a pH greater than 9.

8. A method according to claim 1 wherein the concentration of oxidizing agent in the solution is between about 0.001 and about 10 percent by weight.

9. A method according to claim 8 wherein the concentration of oxidizing agent in the solution is between about 0.01 and about 1 percent by weight.

10. A method according to claim 1 wherein the contact time is between about 0.03 and about 3 hours.

11. A method according to claim 10 wherein the contact time is between about 0.1 and about 1 hour.

12. A method according to claim 1 wherein the activated or reactivated silver cathode is further used for the electrochemical synthesis of 3,6-dichloropicolinic acid from 3,4,5,6-tetrachloropicolinic acid, 3,5,6-trichloropicolinic acid, or mixtures thereof.

* * * * *